United States Patent [19]

Mayer

[11] 4,133,355

[45] Jan. 9, 1979

[54] SEALABLE DISPENSING NOZZLE WITH AUTOMATIC SHUT-OFF

[75] Inventor: Edward A. Mayer, Newburgh, N.Y.

[73] Assignee: Texaco Inc., New York, N.Y.

[21] Appl. No.: 856,708

[22] Filed: Dec. 2, 1977

Related U.S. Application Data

[63] Continuation of Ser. No. 693,572, Jun. 7, 1976, abandoned.

[51] Int. Cl.[2] ..... B65B 57/14

[52] U.S. Cl. ..... 141/217; 141/226; 141/302

[58] Field of Search ..... 141/1, 59, 128, 192, 141/198, 206–229, 285, 301, 302, 392

[56] References Cited

U.S. PATENT DOCUMENTS

| | | | |
|---|---|---|---|
| 3,005,476 | 10/1961 | Klaus | 141/225 |
| 3,710,831 | 1/1973 | Riegel | 141/207 |

*Primary Examiner*—Richard E. Aegerter
*Assistant Examiner*—Frederick R. Schmidt
*Attorney, Agent, or Firm*—ThomasH. Whaley; Carl G. Ries; Robert B. Burns

[57] ABSTRACT

Nozzle for a closed system holding a volatile fuel. The nozzle is adapted to sealably engage the filler pipe of a fuel tank whereby to avoid passage of fumes to the atmosphere during a fuel transfer operation. The nozzle will automatically discontinue fuel flow in response to a malfunction in the closed system, which would otherwise cause recycling of the fuel through the nozzle and back to its source.

4 Claims, 5 Drawing Figures

SEALABLE DISPENSING NOZZLE WITH AUTOMATIC SHUT-OFF

This is a continuation, of application Ser. No. 693,572 filed June 7, 1976 now abandoned.

BACKGROUND OF THE INVENTION

In response to the requirements of both government and industry, means have been provided to avoid the passage of fumes to the atmosphere during the transfer of volatile fuels and liquids from a storage tank thereof, to a fuel tank or the like.

The system adapted to this purpose when applied to an automotive service station, is ordinarily referred to as a closed fuel system. In essence, the system comprises the basic means whereby to effect a fuel transfer operation. A manually operated nozzle is initially inserted into the fuel tank to be filled. Sealing means carried on the nozzle is positioned to form a vapor tight fit with the tank filler tube.

During the actual fuel transfer, fumes which evaporate from the fuel, as well as fumes and air which are displaced from the tank, are carried back through the nozzle. They are then returned to the fuel source or to an alternate accumulation point.

Seal tight nozzles of this type are found to be satisfactory in most instances for effecting the necessary transfer of fuel, as well as for automatically discontinuing fuel flow when the tank becomes filled. However, since the system is entirely segregated and sealed from the atmosphere, there is a chance for an undesired accumulation of vapors. This occurs when they are not properly conducted from the tank being filled.

To overcome the situation which might arise due to a closed system becoming overpressurized, means is usually provided in the fuel dispensing nozzle for discontinuing the flow in response to a predetermined increase in fuel tank pressure. It has been noted that in such systems however, because of the particular arrangement of the nozzle, and the facility therein for handling both liquid fuel and the vapor, under certain circumstances fuel which is pumped from the source, can be recycled through the nozzle. It would thereafter return to the source without ever entering the fuel tank being filled. This circumstance represents an untenable situation. Although the pumped volume of fuel is registered and charged to a customer, it nonetheless might not reach its destination.

The factors which lead toward recycling of the fuel are often prompted by some malfunction in the fuel pumping mechanism. This malfunction can originate at any of several elements within the system prior to fuel reaching the nozzle. In any instance, a characteristic of the malfunction is that the fuel pressure within the system, and within the nozzle itself, decreases noticeably.

Toward overcoming the problem of fuel recycling, there is presently disclosed a nozzle and means therein for automatically discontinuing fuel flow. This action is taken in response to a predetermined pressure decrease at the upstream side of the nozzle's main metering valve. The system comprises the necessary means for determining a pressure differential between a point within the nozzle's fuel flow passage, and the atmospheric pressure. These two reference points are utilized to stabilize the open, or flow condition of the main flow valve. When the stabilized pressure condition is upset due to decrease in pressure within the nozzle, a signal transmitted to the main flow jcontrol valve actuator automatically adjusts said main valve to shut down the fuel system.

It is therefore an object of the invention to provide a fuel dispensing nozzle capable of sensing a decrease in fuel flow volume, and of discontinuing flow through the nozzle. A further object is to provide a seal tight nozzle for a fuel system which is adapted to automatically adjust itself to discontinue fuel therethrough in response to a number of conditions within the system prompted either by overpressuring or underpressuring of the latter. A still further object is to provide a dispensing system for a volatile fuel in which a malfunction in the system, which would ordinarily prompt recycling of the fuel back to its source, is automatically stabilized by sensing of the condition within the dispensing nozzle.

DESCRIPTION OF THE DRAWINGS

In the drawings,

Referring to FIG. 1, a nozzle 10 of the type contemplated is shown in a closed fuel system which is comprised primarily of a source of fuel 11 which is connected to a pump 12. The latter in turn can be actuated to deliver fuel through a conduit 13, through the nozzle 10, and thence to the fuel tank 14 such as is found in an automobile or a boat. The nozzle 10 as shown, is removably positioned in filler pipe 16 of the tank 14 and includes means 17 for providing a vapor tight seal with the latter to complete the closed fuel system.

This system is characteristic of the normal service station wherein an automotive vehicle will be driven to the pump 12 and so positioned to receive the nozzle 10. As is generally done, the nozzle is manually inserted into place by an operator such that the resilient sealing element 17, a rubber boot or the like forms a desired temporary sealed connection between the nozzle 10 and the tank filler pipe 16.

Figure 2:
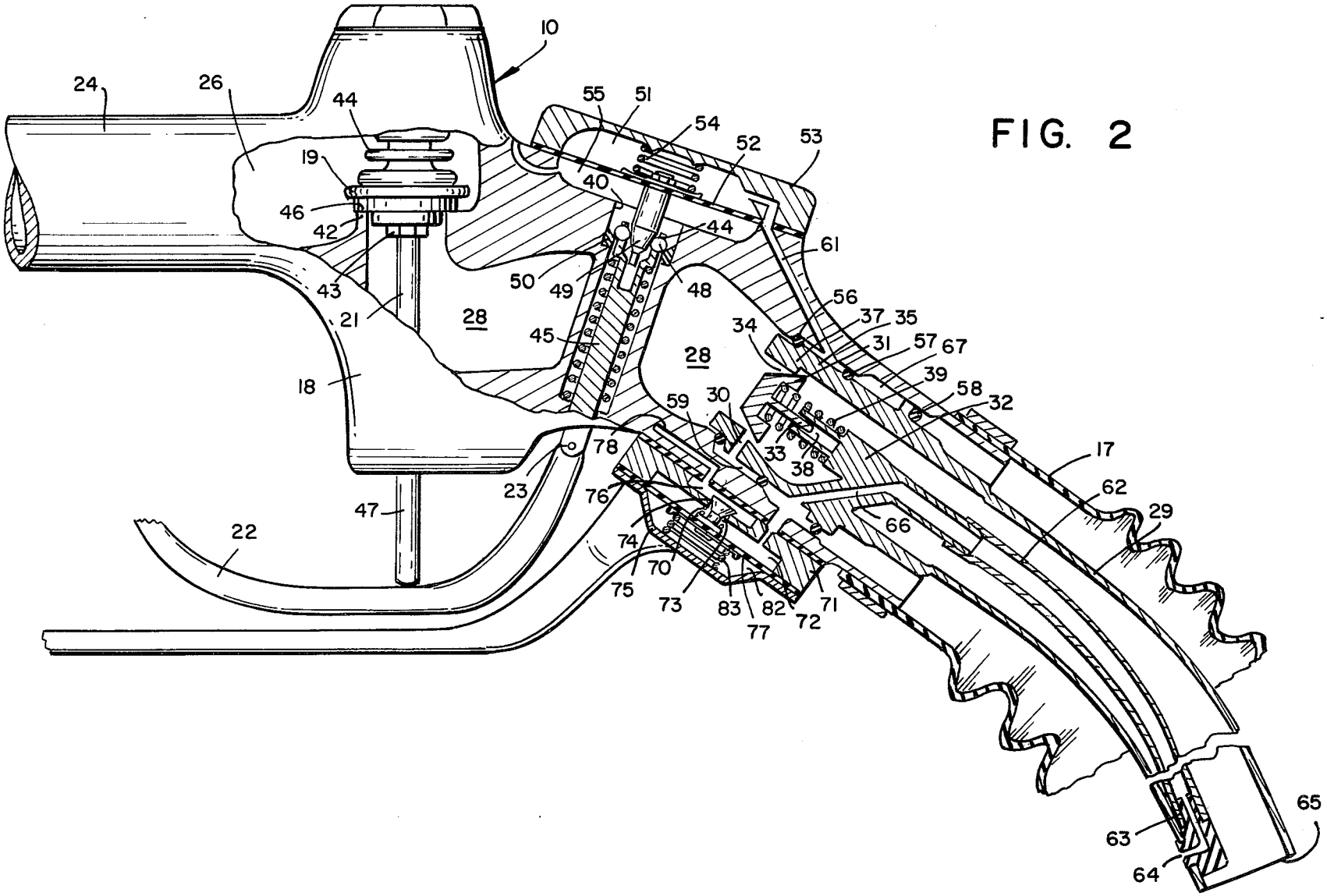
FIG. 2 is an enlarged view in partial cross section of a nozzle of the type contemplated.

Referring to FIG. 2, nozzle 10 comprises basically a body 18 in which a main flow valve 19 is positioned. The latter is connected through an extended plunger 21 to operably engage a manual actuator lever 22. The latter is pivoted at one end 23 to the body, the other end being manually adjustable to achieve a desired fuel flow rate.

Body 18 comprises an elongated handle 24 which encloses the main fuel passage 26, which terminates at the handle remote end at a connection 27. Said connection 27 is adapted to engage elongated, flexible fuel conduit 13 which in turn is connected at its far end to the fuel source or pump 12.

The downstream side of main control valve 19 opens into a fuel passage 28, which in turn is communicated with elongated discharge tube 29 through check valve 31. The elongated discharge tube 29 as shown, is slightly curved to more readily facilitate the fuel transfer operation and to preferably dispose the nozzle in an efficient attitude for achieving the necessary fuel transfer.

Fuel passage 28 formed within nozzle 10 is provided with a central portion having check valve 31 disposed therein. The latter comprises in essence a check valve base 32 supported between the peripheral walls of the circular passage 29. Base 32 includes an upstanding guide column 33 disposed substantially longitudinally of the flow passage. A check valve aperture 34 is formed within said passage 28, by annular seat 37. Check valve 31 further includes a circular frusto conical segment having a circumferential edge which sealably engages seat 37 when urged into the latter by a biasing spring 39. The latter is positioned along a guide pin 33, further engaging the base member 32 to permit oscillatory motion of the check valve. Such valve motion normally occurs in response to the movement of flow of fuel through main control valve 19 and into the downstream passage 28 prior to fuel entering fuel tank 14.

Main valve 19 as shown, includes essentially a circular seat 42 against which a plunger 43 is urged by a biasing spring 44. Plunger 43 includes a circular sealing face 46 which corresponds to seat 42. An elongated extension pin or stem 47 depends from valve plunger 43 and terminates externally of the body 18 to be contacted by actuating lever 22. Main valve 19 is adjusted to open position by pivotally moving actuator lever 22 such that it raises valve stem 47.

The nozzle automatic fuel flow shut-off mechanism is arranged to instantly close valve 19 in response to the occurrence of any of several events. The latter includes the filling of tank 14, a sudden pressure rise downstream of the check valve 31, and a drop off of fuel flow or pressure within the nozzle.

Referring again to FIG. 2, the shut-off system includes an elongated stem 45, which is provided with locking ball 48, seats 40, and which is operably connected to lever 22 at pivot point 23. A conical portion 49 is adjacent to locking balls 48 such that the entire stem 45 can be raised and locked in a desired valve open position. This results from the action of the confining circumferentially placed balls 48 resting against shoulder 50.

Nozzle 10 includes a plenum chamber 51 having a diaphragm 52 disposed thereacross, being sealably held in place about the periphery by a cap 53. The latter is provided with an internal cavity which, together with diaphragm 52 forms adjustable chamber 51. The underside of diaphragm 52 encloses a vented chamber 55. A spring 54 is guidably positioned within chamber 51 against the cap 53. The combined action of spring serves to urge diaphragm 52, and consequently the pin 49, normally in the downward direction to lock stem 45 in the valve open position.

Check valve 31 is disposed within the inner portion of discharge tube 29 such that preferably the latter is removable from nozzle body 18. To achieve the necessary vapor tight relationship when tube 29 is assembled with body 18, circular "O" rings 56, 57 and 58 are compressed into place. Rings 56 and 57 form a pair of circular seals having an annular chamber 59 therebetween. Elongated passage 61 extended through the body 18 wall, transverses diaphragm 52 to communicate said annular passage 59 with plenum chamber 51. The latter, due to the pivotal connection with lever 22 and main valve 19, forms the main valve actuator.

The nozzle flow shut-off and sensing system for discontinuing fuel flow by closing valve 19 in response to overpressuring the system or the filling of fuel tank 14, comprises an elongated sensing tube 62. The latter extends through discharge tube 29 and terminates adjacent the tube open end at a tip 63 having an aperture 64 in the discharge tube wall. Said conduit 62 is communicated through a passage 66 formed in the central web of the discharge tube 29, which in turn communicates with a second annular passage 67 defined between "O" rings 58 and 57.

A disc-like member 71 is positioned against the underside of the nozzle body 18 by appropriate means such as screws or the like. Said disc member 71 includes a cavity 72 formed therein, and a second sensing valve element 73 positioned centrally thereof. Second sensing valve element 73 is supported by spring 70 and includes a conical head which is longitudinally movable within the disc-like member 71 to engage a circular seat 74. It will thus form a fluid tight seal when urged thereagainst. A minor cavity 76 is formed in member 71. Chamber 72 is closed by diaphragm 77 which in effect forms an expandable chamber adjacent the second sensing valve 73.

Figure 1:
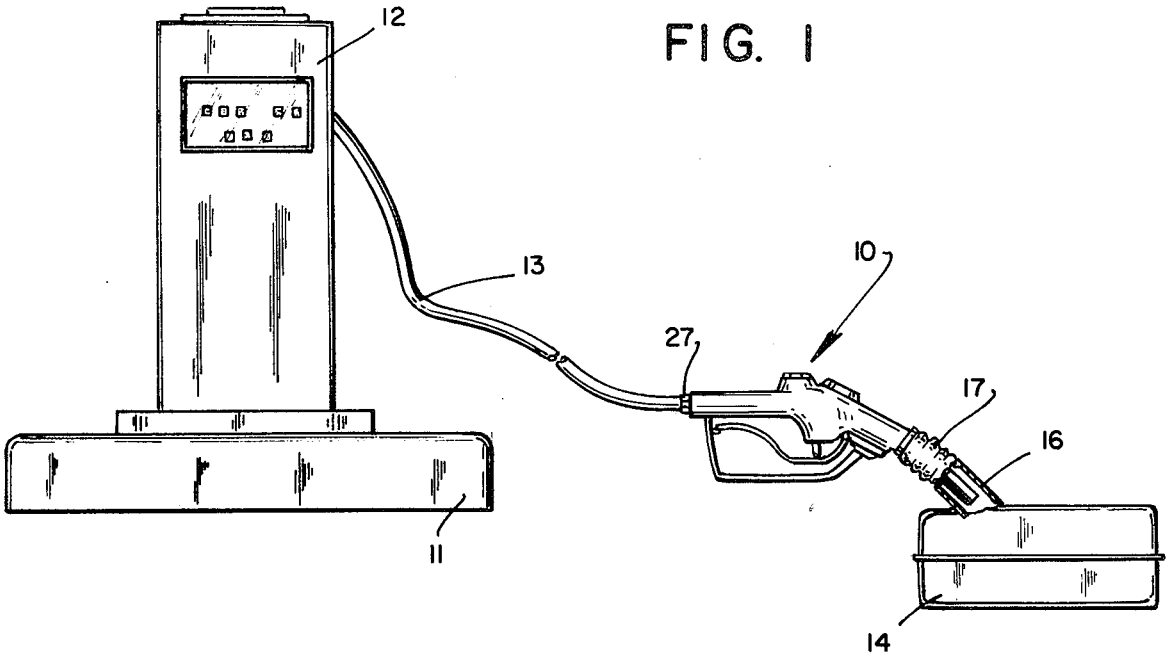
FIG. 1 is an environmental view of the nozzle of the type contemplated shown in conjunction with a fuel source and a fuel tank.
Figure 3:
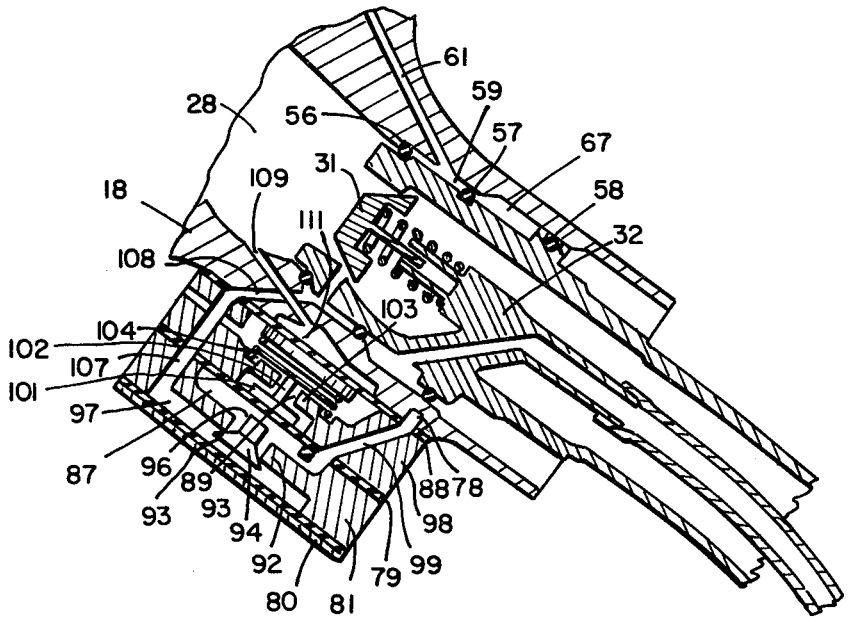
FIG. 3 is a segmentary view on an enlarged scale of a portion of the nozzle shown in FIG. 2.

Referring to FIGS. 2 and 3, cavity 76 is communicated through a single passage 78 with a first sensing valve operator 79. A generally disc-shaped vented cover 75 carried on the disc-like member 71 encloses a vented chamber 82. Compression spring 83 within chamber 82, acts against diaphragm 77 to normally urge the diaphragm downwardly into the chamber 72, and consequently to urge valve 73 into an open position.

Figure 4:
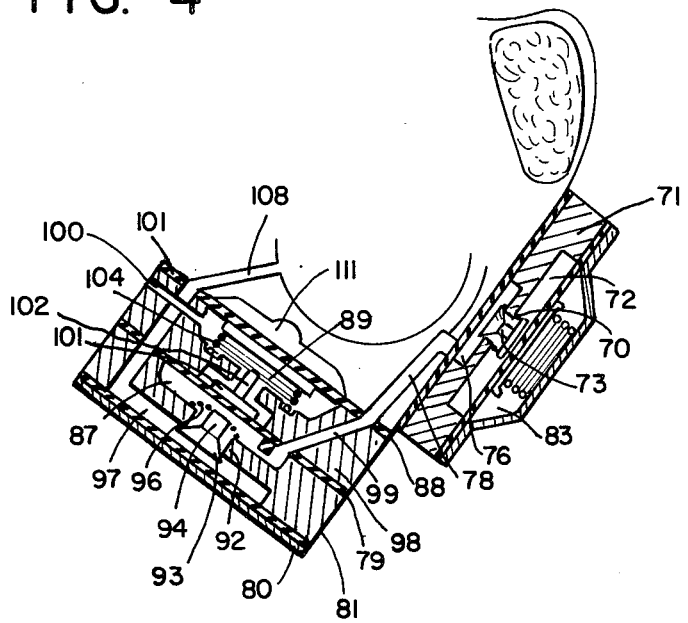
FIG. 4 is similar to FIG. 3.

Referring to FIGS. 3 and 4, transverse passage 78 formed in the body 18 communicates with the first pressure sensing valve actuator. The latter comprises valve body 81 formed of a first member having cavities 87 and 97 formed therein. Said body 81 is fastened into contact with a diaphragm 79. A corresponding cavity 87 formed in the valve body 81 permits diaphragm 79 to be displaced in response to the motion of plunger 102 within chamber 87 to provide the result hereinafter noted.

The lower end of body 81 includes a cavity 97 provided with a guide section or seat 92 which slidably accommodates a plunger or valve 94 having a conical face 93. Spring 96 carried in chamber 87 normally urges plunger 94 into a closed position, against valve seat 92. A cover plate 80 fastened against body 81 forms an air tight closure to chamber 97.

The upper end of the body 81 is provided with a second member 98 having diaphragm 88 about its periphery to enclose expandable cavity 89 within said second member. Cavity 89 is vented to the atmosphere through passage 100. Second body 98 is provided with a passage 99 extending therethrough which communicates at one end with chamber 87, and at the other end communicates with the cross passage 78 by way of an opening in diaphragm 88.

A movable plunger 102 is positioned within guide 103 having one side engaging diaphragm 79. Said plunger 102 can engage piston 101 which is normally urged in an upward direction by a biasing spring 104 to engage diaphragm 88 in vented chamber 89. On the upward side of diaphragm 88 a connecting passage 109 communicates compartment 111 with a sensing point preferably positioned in fuel passage 28 between flow control valve 19 and check valve 31.

A connecting passage 107 communicates chamber 97 in body 81 with passage 108 in body 18 through diaphragm 79 and diaphragm 88 respectively. Passage 108 in turn communicates with annulus 59 which in turn communicates through passage 61 to cavity 51.

Figure 5:
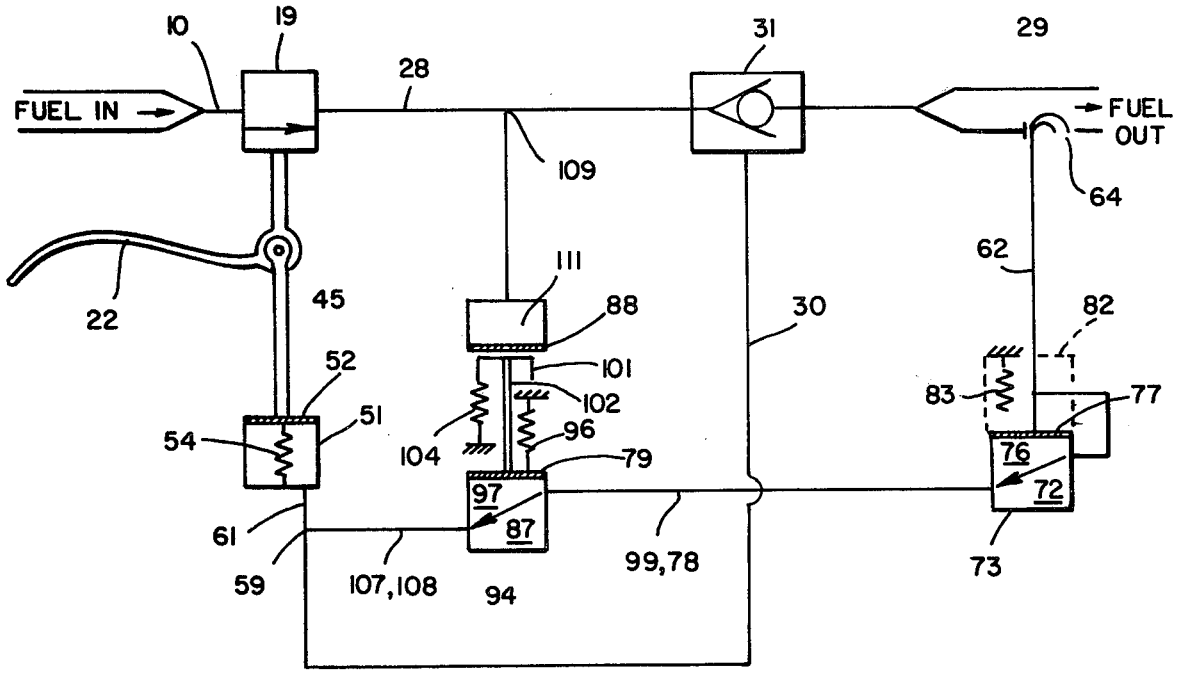
FIG. 5 is a schematic sketch illustrating the various elements of the nozzle shown in FIG. 2.

Operationally, and referring to the schematic diagram of FIG. 5, the instant sealable, dispensing nozzle 10 functions both manually and automatically. Initially, fuel flow through valve 19 is commenced by displacing lever 22 to an upward position after stem 15 is locked. Fuel flow will then proceed from the source 12, through valve 19, through passage 28 through check valve 31, and thence into discharge tube 29.

Thereafter the nozzle sensing system will come into operation to automatically discontinue the flow. Upon the happening of any one of several events, said flow will be discontinued:

(a) when fuel rises within the tank filler tube a sufficient distance to cover sensing point 64, (b) when the pressure sensed at point 64 exceeds a predetermined value, or (c) when the fuel flow has decreased below a predetermined volume, a condition that is reflected by a drop of pressure within passage 28.

The sensing system, by virtue of the open connection between check valve 31 constricted opening 30, and downstream sensing points 64, forms an open passage. Thus, said open system in effect communicates the main valve actuator 51 with sensing point 64, subject to the condition in passage 28, sensed at point 109. During this period of full flow, the main valve actuator 51 will be acted on in a manner that the pressure of spring 54 will act against diaphragm 52. Said action will balance the flow through passage 61 and the sensing system such that diaphragm 52 will maintain a stabilized position.

During normal fuel flow, main valve 19 will of course be in the open position; check valve 31 will be forced open by virtue of the fuel pressure thereagainst. Fuel pressure within passage 28 downstream of valve 19 will be transmitted to chamber 111. The downward movement of diaphragm 88 against piston 101 and spring 104 will thus displace plunger 102 which in turn bears against diaphragm 79. Inward movement of the latter displaces plunger 94 thereby communicating chamber 97, which is communicated with passages 107 and 108 and then through valve 94, with chamber 87.

The latter is communicated through passage 99 and 78 to chamber 76 and by way of valve 73, with chamber 72. Valve 73 is acted on by spring 83 within the vented chamber 82 through diaphragm 77 such that the open position of the said valve 73 is maintained so long as a diminished pressure exists in the sensing tube 62 and downstream sensing point 64.

Upon the occurrence of a rise within the fuel tank filler pipe 16, downstream sensing point 64 will become submerged in fuel. The resulting reduction of the pressure within the sensing system due to the check valve 31 operation, will maintain valve 73 in the open position. This low pressure will be communicated to chamber 51. However, the pressure within chamber 51 will then be reduced such that the resulting upward movement of diaphragm 52 will cause locking balls 48 to release the stem 45. This movement will release lever 22 from its displaced position, which in turn permits valve 19 to close.

Upon a build-up of pressure within either the fuel tank 14 or nozzle 10, due to fumes or fuel being trapped therein, the pressure at the downstream sensing point 64 will be sensed and transmitted through sensing tube 62. Pressure acting against diaphragm 77 will cause the latter to be displaced against spring 83 thus allowing spring 70 to close valve 73. This of course again upsets the overall sensing system in the same manner as described above, which system is communicated with chamber 51 such that diaphragm 52 is again displaced to release the lever 22, and again discontinue flow through the nozzle by closing valve 19.

At such time as a reduced fuel flow is realized through nozzle 10 due to some malfunction within the fuel system, or within the pumping mechanism, this reduced pressure will first be noted at flow passage 28 downstream of the open main flow valve 19. This reduction in pressure will be transmitted to closed chamber 111. Since spring 104 serves to maintain the equilibrium of piston 101 against pressures in chamber 111 acting on diaphragm 88, upon reduction of the pressure within said chamber, the said diaphragm 88 will be displaced into chamber 111. The movement of diaphragm 88 will permit plunger 102 to be lifted and as a consequence force against the diaphragm will be reduced, permitting valve 94 to close by action of spring 96.

With the closure of said valve 94 flow through the sensing system will again be interrupted as described above resulting in the subsequent upsetment of the pressure within actuator 51 to cause the displacement of diaphragm 52 with the release of the stem 45. Thus, and as has been noted, lever 22 will be released from its locked position to permit valve 19 to close, which event will again shut off fuel flow through the nozzle.

Other modifications and variations of the invention as hereinbefore set forth may be made without departing from the spirit and scope thereof, and therefore, only such limitations should be imposed as are indicated in the appended claims.

I claim:

1. In a dispensing nozzle for transferring a volatile fuel from a source thereof to a fuel tank having a filler pipe, said nozzle including a body, a discharge tube depending from the body to register in a tank filler pipe, and having means on said body for sealably engaging said tank filler pipe to define a removable, vapor tight joint, means forming a main fuel flow passage in said body, a main flow valve (19) in said fuel flow passage being adjustable to an open position to allow fuel flow into said fuel tank, and a main valve (19) actuator, including means forming a closed chamber (51), a diaphragm (52) disposed across said chamber (51) to form a displaceable wall thereof, and a connector (22, 45) engaging said diaphragm (52) with said main valve (19), whereby displacement of said diaphragm (52) will release said main valve (19) from an open position to thereby discontinue fuel flow through said main fuel flow passage, means forming a constriction (31) across said main fuel flow passage to establish a reduced pressure therein when fuel flows through the constriction (31), first passage means (61) communicating said constriction (31) with said chamber (51) to apply a reduced pressure against one side of said diaphragm (52) during periods of fuel flow through the nozzle, said reduced pressure being insufficient to substantially displace the diaphragm (52), a sensing circuit in said nozzle to regulate fuel flow therethrough and including, means forming an elongated sensing passage having a sensing point (64) at the remote end thereof disposed in said discharge tube, and having the sensing passage other end being communicable with said constriction (31), and said first passage means (61), first and second valve means (73, 94) serially communicated in said means forming said elongated sensing passage, said respective valves being concurrently operable to an open position whereby to communicate said sensing point (64) with said constriction (31) and said first passage means (61), said first valve (94) including a first valve actuator (102, 111), and second passage means (109) communicating said first actuator (102, 111) with said main fuel flow passage at a point in the latter upstream of said constriction (31), whereby said first valve (94) will be urged into open position only in response to a predetermined minimal fuel pressure at said second passage (109), said second valve (73) including a second valve actuator (77, 83) positioned to urge said second valve (73) into open position, whereby said second valve (73) will be urged to a closed position only in response to a predetermined increase in pressure in said sensing passage downstream of said second valve (73)

whereby upon the closing of either of said valves (73, 94) said elongated sensing passage will be closed, thereby allowing said reduced pressure against one side of said diaphragm (52), to become increased a sufficient amount to cause the displacement of the diaphragm, and the subsequent closing of main valve (19) whereby to end fuel flow through the nozzle main fuel flow passage.

2. In an apparatus as defined in claim 1, wherein said passage (109) is communicated with the main fuel flow passage at a point immediately adjacent to the upstream side of said constriction (31).

3. In an apparatus as defined in claim 1, wherein said passage (109) is communicated with said main fuel flow passage at a point intermediate constriction (31), and the main valve (19).

4. In an apparatus as defined in claim 1, wherein said passage (109) is communicated with said main fuel flow passage at a point upstream of said main valve (19).

* * * * *